US006784862B2

(12) United States Patent
Kodate et al.

(10) Patent No.: US 6,784,862 B2
(45) Date of Patent: Aug. 31, 2004

(54) ACTIVE MATRIX DISPLAY DEVICE AND INSPECTION METHOD FOR THE SAME

(75) Inventors: Manabu Kodate, Yokohama (JP); Masato Ikeda, Shiga-ken (JP)

(73) Assignee: International Business Machines Corporation, Armonk, NY (US)

( * ) Notice: Subject to any disclaimer, the term of this patent is extended or adjusted under 35 U.S.C. 154(b) by 252 days.

(21) Appl. No.: 09/808,321

(22) Filed: Mar. 14, 2001

(65) Prior Publication Data

US 2001/0030635 A1 Oct. 18, 2001

(30) Foreign Application Priority Data

Mar. 14, 2000 (JP) ..... 2000-070203

(51) Int. Cl.[7] ..... G09G 3/36

(52) U.S. Cl. ..... 345/92; 345/98; 345/100; 345/904; 349/54; 349/139; 349/152; 349/192; 324/527; 324/770

(58) Field of Search ..... 345/87, 89, 92–94, 345/98–100, 204–206, 904, 103; 349/139–140, 150–152, 54, 192; 324/527, 537, 765, 770; 714/724, 726, 729, 742, 743; 702/57–60, 117–118

(56) References Cited

U.S. PATENT DOCUMENTS 5,339,093 A * 8/1994 Kumagai et al. ..... 345/89
5,453,991 A * 9/1995 Suzuki et al. ..... 714/724
5,576,730 A * 11/1996 Shimada et al. ..... 345/98
5,774,100 A * 6/1998 Aoki et al. ..... 345/87
5,945,984 A * 8/1999 Kuwashiro ..... 345/206
6,100,865 A * 8/2000 Sasaki ..... 345/92
6,590,624 B1 * 7/2003 Lee ..... 349/54
6,624,857 B1 * 9/2003 Nagata et al. ..... 349/54

FOREIGN PATENT DOCUMENTS

| | | |
|---|---|---|
| JP | 60-2989 | 1/1985 |
| JP | 3-18891 | 1/1991 |
| JP | 3-20721 | 1/1991 |
| JP | 5-5897 | 1/1993 |
| JP | 5-11000 | 1/1993 |
| JP | PUPA 07-333275 | 12/1995 |
| JP | PUPA 11-149092 | 6/1999 |
| JP | 11-160673 | 6/1999 |
| JP | PUPA 11-338376 | 12/1999 |
| JP | 11-338376 | 12/1999 |

* cited by examiner

*Primary Examiner*—Henry N. Tran
(74) *Attorney, Agent, or Firm*—Scully, Scott, Murphy & Presser; Derek S. Jennings, Esq.

(57) ABSTRACT

An active matrix display device has an inspection circuit for inspecting the image quality. The inspection circuit includes a plurality of input terminals for inputting a test signal and a plurality of test transistors connected respectively to the input terminals. Input test signals which are to be sent to sub pixel sections from the individual input terminals are controlled by the associated test transistors to display a desired test screen. The test transistors are preferably amorphous silicon TFTs.

39 Claims, 3 Drawing Sheets

ACTIVE MATRIX DISPLAY DEVICE AND INSPECTION METHOD FOR THE SAME

FIELD OF THE INVENTION

The present invention relates to an active matrix display device and an inspection method for the same, more particularly to an active matrix display device having an inspection circuit for the display device and an inspection method for the same.

BACKGROUND OF THE INVENTION

The manufacturing process for a thin film transistor (TFT) color liquid crystal display device which has been widespread today can be roundly separated into a manufacturing process for a liquid crystal (LC) cell, a manufacturing process for an LC module and a manufacturing process for an LC monitor. The LC module is completed by connecting, to the LC cell, a driver IC and a drive circuit which generates control signals to be inputted to the driver IC, and attaching a back light and mechanical components. Further, the LC monitor is completed by connecting a graphics adapter, which generates signals including image information to be inputted, to this LC module, and attaching mechanical components.

In the manufacturing of LC display devices, it is necessary to find defects, at an early stage, originated from dust entered or a dimensional error occurred in the manufacturing process in order to improve the manufacturing efficiency. In this respect, various tests, such as a gap test and a lighting test, are conducted in the respective stages of the manufacturing process for the LC display devices.

For example, Japanese Patent Laid-Open No. Sho 60-2989 discloses a method of detecting disconnection and short-circuiting of data/scan lines of a TFT array. With this method, disconnection of data/scan lines can be detected in an LC display device having only one X drive circuit. Disconnection and short-circuiting of the data/scan lines are detected by providing test transistors on the opposite side to the X drive circuit. Specifically, a specific test signal inputted from the drive circuit is outputted from the test transistors to carry out the inspection.

Further, Japanese Patent Laid-Open Nos. Hei 3-18891, 3-20721, 5-5897 and 5-11000 disclose schemes of inspecting an active matrix array by connecting signal lines or switching circuits for inspection to the active matrix array on the opposite side to the drive circuit.

Japanese Patent Laid-Open No. Hei 2-154292 describes a disconnection test on an active matrix array before connecting a driver IC to the array by using a selector circuit which has an analog switching function.

One of these inspection techniques is an image quality inspection which is performed after a TFT LC cell is completed. There are various ways to inspect the image quality of a TFT LC cell, and a typical inspection scheme is a multiple pin probe method.

According to this method, in the last step of manufacturing an LC cell, multiple pin probes independently contact all the signal input terminals of the LC cell to input electrical signals equal to input signals from a driver IC in an LC module. This method can completely recreate the driving of an LC cell as a final product, hence, the inspection can be carried out by visually checking the display screen of the final product. In this case, adequately preparing the input signals can permit every kind of screen to be displayed.

However, the inspection with the multiple pin probe system has the following problems.

First, multiple pin probes are expensive and need a significant time for its fabrication. For an LC cell having 1024 pixels (×3 sub pixels)×768 rows, for example, there should be at least 3840 signal input lines, hence, inspection of the image quality requires probes which can contact nearly 4000 signal input terminals.

There is also a matter of inspection stability. In accordance with the recent trend of larger and higher definition LC cells, the probe portions increase and their density becomes higher, hence, one should consider unstable electric contact of the probes. When electric contact becomes unstable, a signal to be inputted does not travel through some signal input lines and a test screen associated with such lines will not be displayed. This considerably reduces the inspection efficiency. This is fatal in the case of performing automatic inspection by means of image processing. Further, since an improvement on the high definition of an LC cell narrows the gap between the probes adjacent to each other, there is a certain limit to the preparation of such probes, not to mention the reduction in inspection reliability.

In addition, such multiple pin probes cannot be adapted to multi-production, thus resulting in a higher cost and a lower inspection efficiency. This is because for multi-production of LC cells, it is difficult to provide a common layout for probes between different types of products due to the difference in specifications of the individual types of products and it is necessary to prepare probe sets product by product and change one probe set mounted to the inspection apparatus to another product set.

In view of the above, there is a demand for an inspection method which does not require the multiple pin probes even if the kinds of test screens to be displayed are limited.

SUMMARY OF THE INVENTION

A feature of the present invention is to provide a display device and an inspection method for the same, which are capable of efficiently inspecting the image quality.

Another feature of the present invention is to provide a display device having an inspection circuit that can cope with multiple image quality inspections, and an inspection method for the same.

A further feature of the present invention is to provide a display device and an inspection method for the same, which are capable of reliably self inspection.

It is a still further feature of the present invention to provide an apparatus and an inspection method for the same, which are capable of reliably inspection of a large and high-definition display device.

It is a yet further feature of the present invention to provide a display device and an inspection method for the display device, which are capable of efficiently inspecting the image quality prior to the attachment of a driver IC to the display device.

An active matrix display device according to the present invention has an inspection circuit for inspecting the image quality. This inspection circuit includes a plurality of input terminals for inputting a test signal and a plurality of test transistors connected respectively to the input terminals. Input test signals which are to be sent to sub pixel sections from the individual input terminals are controlled by the associated test transistors to display a desired test screen. The test transistors are preferably amorphous silicon TFTs.

For a more complete understanding of the present invention and the advantages thereof, reference is now made to the following description taken in conjunction with the accompanying drawings.

DETAILED DESCRIPTION OF THE PREFERRED EMBODIMENTS

A plurality of test transistors are connected to a single input terminal. It is preferable that all the gate electrodes of the test transistors are connected to a single input terminal. The other input terminals are connected to the source electrodes of the test transistors. It is preferable that those test transistors which are connected to adjacent columns of sub pixel sections are connected to different input terminals. These test transistors which are connected to columns of sub pixel sections of different colors are connected to different input terminals.

It is preferable that the inspection circuits are formed on both the data signal line side and the scan signal line side. It is more preferable that one of the inspection circuits has at least three input terminals. One of the input terminals is connected to the gate electrodes of all the test transistors, and the other two input terminals are alternately connected to the test transistors connected to adjacent columns of sub pixel sections. The other inspection circuit has at least seven input terminals, one of which is connected to the gate electrodes of all the test transistors. With regard to the other input terminals, these test transistors which are connected to columns of sub pixel sections which have different colors of RGB are connected to different input terminals. Further, those test transistors which are connected to adjacent columns of sub pixel sections are connected to different input terminals. That is, the number of the other input terminals of the other inspection circuit is a total of six, three for the respective RGB colors for odd columns of sub pixel sections and three for the respective RGB colors for even columns of sub pixel sections.

Figure 1:
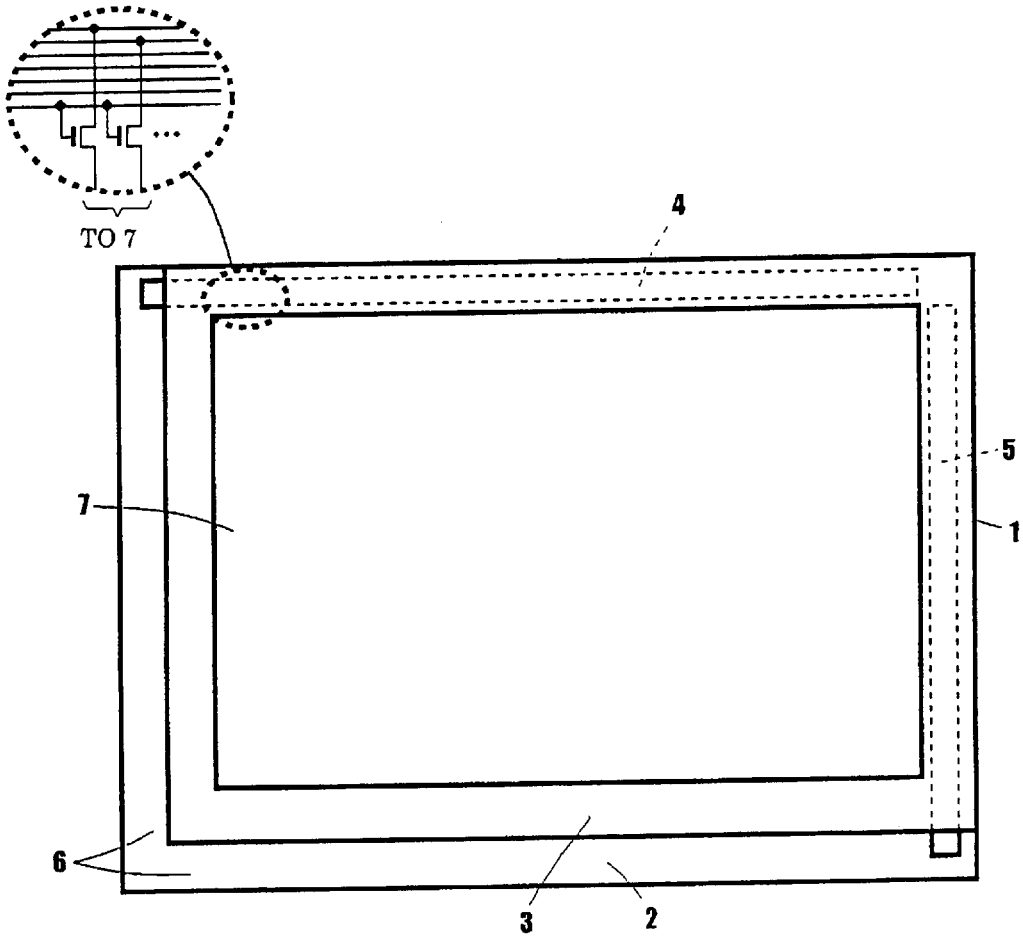
FIG. 1 is a schematic diagram showing the constitution of the LC cell according to one embodiment of the present invention.

FIG. 1 is a schematic diagram showing the entire structure of an LC cell according to one embodiment of the present invention. In FIG. 1, reference numeral 1 denotes a liquid crystal (LC) cell, numeral 2 denotes a thin film transistor (TFT) array substrate and numeral 3 denotes an opposing substrate arranged in parallel to the TFT array substrate 2. Though not illustrated, a liquid crystal is sealed between the TFT array substrate 2 and the opposing substrate 3 by means of a seal member and sealing resin. The LC cell 1 has an alignment film, a transfer, a polarization film and so forth formed therein, with the distance between both the substrates kept by spacer balls provided therebetween. According to this embodiment, the opposing substrate 3 is a color filter substrate having RGB color filters formed thereon.

The alignment film is formed on each of the opposing surfaces of the two substrates in order to determine the initial alignment of the liquid crystal. The seal member is formed outside a display pixel area 7 to adhere the two substrates and seal the liquid crystal between them. The sealing resin is formed to air-tightly seal the liquid crystal in between the two substrates which has been injected between the two substrates from a previously-formed injection port, which is an area where the seal member is not formed. The spacer balls are spherical insulators for determining the gap between the two substrates and are sprayed on one of the substrates. The transfer formed outside the display pixel area 7 is made of a conductive material for supplying a common electrode potential inputted from a terminal on the TFT array substrate 2 to a common electrode on the opposing substrate 3. The polarization film is formed on each outer side of the adhered two substrates to control the polarization of light incident onto the LC cell.

Figure 2:
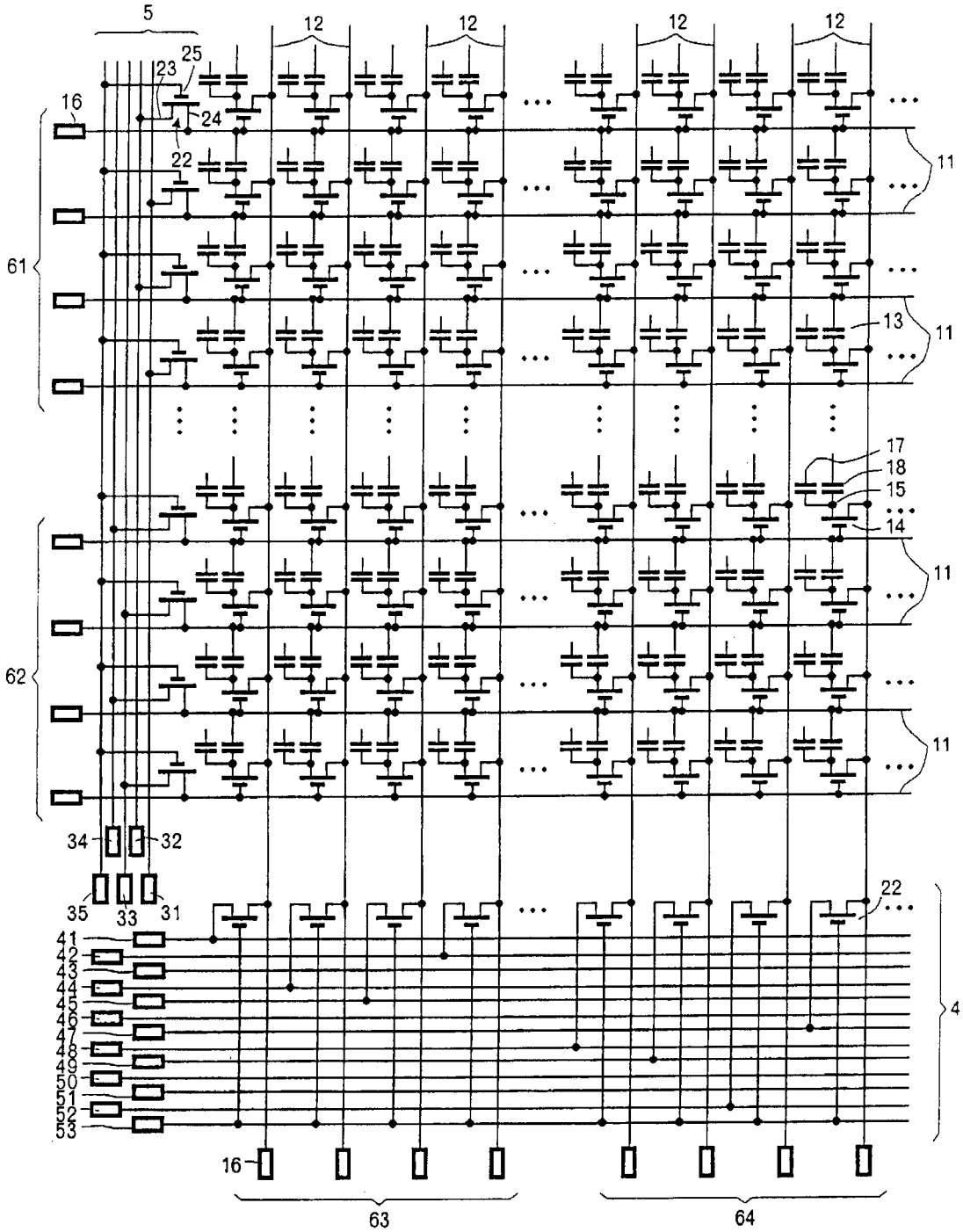
FIG. 2 is a schematic diagram showing the circuit structure of the LC cell according to this embodiment.

Referring to FIG. 1, inspection circuits 4 and 5 for inspecting the image quality of the LC cell are formed on the TFT array substrate 2. The display pixel area 7 is a display area in the LC cell which actually makes display. Provided around the display area is an area 6 on which display-signal input terminals 16 are formed. A driver IC which inputs screen display signals to the display area is connected to the display-signal input terminals 16. TFT Array Circuit FIG. 2 is a schematic diagram showing the circuit structure of the TFT array substrate 2. Referring to this diagram, a plurality of scan signal lines 11, to which a scan signal is supplied, extend in parallel to one another in one direction, and a plurality of data signal lines 12, to which a data signal is supplied, extend in parallel to one another in a direction crossing the scan signal lines 11. The TFT array substrate 2 has a plurality of sub pixels 13 arrayed in a matrix fashion in the display pixel area 7, and each sub pixel 13 is surrounded by the associated scan signal lines 11 and data signal lines 12. Each sub pixel 13 has a pixel electrode 15 (ITO film) for applying an electric field to the liquid crystal, an storage capacitor (Cs) 18 for supplementing the data retentivity of the pixel electrode 15 and a TFT 14 which connects the associated scan signal line 11 and the data signal line 12 to the pixel electrode 15 and has a switching capability. Formed outside the display pixel area 7 are the inspection circuits 4 and 5 for inspecting the image quality of the LC cell, and the display-signal input terminals 16 for providing the lines 11 and 12 with electrical signals. The structures of the image-quality inspection circuits 4 and 5 will be described in detail later.

Formed on the color filter substrate 3 (not shown) are color filters for separating white light into the individual RGB colors, and a common electrode 17 for controlling the alignment of the liquid crystal based on the electric field applied between the electrode 17 and each pixel electrode 15 on the TFT array substrate 2. Each sub pixel 13 has a color filter for one of the RGB colors. The display of the LC cell can be accomplished by controlling the alignment of the sealed liquid crystal based on the potential difference between each pixel electrode 15 and the common electrode 17. This potential difference control is carried out by manipulating input signals by means of the TFTs 14. The alignment of the liquid crystal controls the amount of light that passes the LC cell. Note that three RGB sub pixels 13 constitute a single pixel.

In this embodiment, the TFTs 14 are formed of amorphous silicon, and the image-quality inspection circuits 4 and 5 have amorphous silicon TFTs. Therefore, the image-quality inspection circuits 4 and 5 can be formed at the same time when the TFTs 14 are formed by adding their circuit patterns on a photo mask. It is also possible to form the interconnecting lines and the test terminals of the image-quality inspection circuits 4 and 5 at the same time when the interconnecting lines and the display-signal input terminals 16 of the LC display circuit are formed. This eliminates the need for additional fabrication steps in forming the image-quality inspection circuits 4 and 5. Since the fabrication of a TFT array substrate is carried out by well-known techniques, such as deposition and etching processes using photo resists, its detailed description will not be given.

The image-quality inspection circuits 4 and 5 will be discussed below. FIG. 2 presents a circuit diagram schematically showing the circuit formed on the TFT array substrate 2 in this embodiment. For the sake of descriptive convenience, the diagram shows only a partial structure of the circuit, not the entire structure. Referring to the diagram, test TFTs 22 are connected to the respective scan signal lines 11 or the respective data signal lines 12. Each test TFT 22 has a source electrode 23, a drain electrode 24 and a gate electrode 25. Reference numerals 31 to 35 denote test terminals connected to the scan signal lines 11, and reference numerals 41 to 53 denote test terminals connected to the data signal lines 12. There are a total of eighteen types of test signals to be inputted to this circuit, five types inputted to the scan signal lines and thirteen types inputted to the data signal lines.

The display area is separated into a plurality of blocks, to each of which one set of scanning-side test terminals and one set of data-signal-side test terminals are connected. The scan signal lines and the data signal lines for a specific area are allocated block by block. The test terminals 31 and 32 form one set and the test terminals 33 and 34 form another set, and both sets are connected to source electrodes 23 of the test TFTs 22. The test terminal 35 is connected to gate electrodes 25 of all the scan-side test TFTs 22. The test terminals 41 to 46 form one set and the test terminals 47 to 52 form another set, and both sets are connected to the source electrodes 23 of the test TFTs 22 via common source lines. The test terminal 53 is connected to the gate electrodes 25 of all the data-signal-side test TFTs 22 via a common gate line. It is needless to say that the source and drain electrodes can be reversed.

The test terminals 31 to 34 on the scan-signal line side are connected as follows. The test terminals 31 and 32 are alternately connected to the scan signal lines 11 of an area 61 corresponding to a certain block via the test TFTs 22. Specifically, the test terminal 31 is connected to the (2m+1)-th scan signal lines 11 of the area 61, while the test terminal 32 is connected to the (2m+2)-th scan signal lines 11 of the area 61 (m: an integer).

Likewise, the test terminals 33 and 34 are alternately connected to the scan signal lines 11 of another area 62 different from the area 61 via the test TFTs 22. Specifically, the test terminal 33 is connected to the (2n+1)-th scan signal lines 11 of the area 62, and the test terminal 34 is connected to the (2n+2)-th scan signal lines 11 of the area 62 (n: an integer). Although each area includes only four rows of sub pixels in the diagram, it actually contains a greater number of rows of sub pixels.

The scan-line side inspection circuit 5 is constructed in the above manner, hence, test signals can be inputted by selecting an odd scan signal line and an even scan signal line in each block at different timings. This makes it possible to cope with row inversion driving, which is one of AC driving schemes of inverting the polarity of the voltage to be applied to the liquid crystal frame by frame, and pixel inversion (dot inversion) driving, in accordance with the potential that is applied to the data signal lines. Even if an odd scan signal line and an even scan signal line are selected simultaneously, frame inversion driving can be carried out by inverting the potential to be applied to the data signal lines frame by frame.

The aforementioned connection allows the scan signal lines of the areas 61 and 62 to be selected at different timings. As a result, different patterns can be displayed on the areas 61 and 62 on the display screen in accordance with the potential that is applied to the data signal lines.

The test terminals 41 to 46 on the data-signal line side, which constitute one set, are connected as follows. The test terminals 41 and 42 are respectively connected to (6p+1)-th and (6p+4)-th data signal lines 12 (p: an integer) of one area 63 via the test TFTs 22. At this time, the test terminals 41 and 42 are connected to the source electrodes 23 of the test TFTs 22, and the data signal lines 12 are connected to the drain electrodes 24. It is needless to say that the source and drain electrodes can be reversed.

The test terminals 43 and 44 are respectively connected to (6p+5)-th and (6p+2)-th data signal lines 12 (p: an integer) of the area 63 via the test TFTs 22. At this time, the test terminals 43 and 44 are connected to the source electrodes 23 of the test TFTs 22, and the data signal lines 12 are connected to the drain electrodes 24. The test terminals 45 and 46 are respectively connected to (6p+3)-th and (6p+6)-th data signal lines 12 (p: an integer) of the area 63 via the test TFTs 22. At this time, the test terminals 45 and 46 are connected to the source electrodes 23 of the test TFTs 22 and the data signal lines 12 are connected to the drain electrodes 24.

The test terminals 47 to 52 on the data-signal line side, which constitute another set, are connected to the data signal lines 12 of an area 64 different from the area 63. The test terminals 47 and 48 are respectively connected to (6q+4)-th and (6q+1)-th data signal lines 12 (q: an integer) of the area 64 via the test TFTs 22. At this time, the test terminals 47 and 48 are connected to the source electrodes 23 of the test TFTs 22, and the data signal lines 12 are connected to the drain electrodes 24.

The test terminals 49 and 50 are respectively connected to (6q+2)-th and (6q+5)-th data signal lines 12 (q: an integer) of the area 64 via the test TFTs 22. At this time, the test terminals 49 and 50 are connected to the source electrodes 23 of the test TFTs 22, and the data signal lines 12 are connected to the drain electrodes 24. The test terminals 51 and 52 are respectively connected to (6q+6)-th and (6q+3)-th data signal lines 12 (q: an integer) of the area 64 via the test TFTs 22. At this time, the test terminals 51 and 52 are connected to the source electrodes 23 of the test TFTs 22, and the data signal lines 12 are connected to the drain electrodes 24. Although each area includes only four columns of sub pixels in the diagram, it actually contains a greater number of columns of sequential sub pixels.

The LC cell 1 of this embodiment has RGB sub pixels arrayed in vertical stripes. That is, the columns of sub pixels that are defined by the data signal lines (the vertical columns in FIG. 2) have RGB color filters in order. With the above-described constitution of the data-signal-line side inspection circuit 4, voltages having polarities opposite to each other can be applied to the liquid crystal in the adjacent columns of sub pixels. Since voltages can be independently applied to columns of sub pixels of R, G and B, arbitrary colors can be displayed on the entire display area. Further, different patterns can be displayed on the areas 63 and 64 on the display screen by changing the potentials that are applied to the data signal lines of the areas 63 and 64.

A description will now be described for a method of inspecting the image quality of the LC cell 1. According to this inspection method, output images are inspected by causing probes providing test signals to contact the test terminals 31 to 35 and 41 to 53, while in the conventional inspection method, output images are inspected by causing probes providing a scan signal and video data signals (video signals) to contact the electrode terminals 16 of the LC cell 1. The signals that are sent to the sub pixel sections from the test terminals can be controlled by manipulating the test TFTs.

Figure 3:
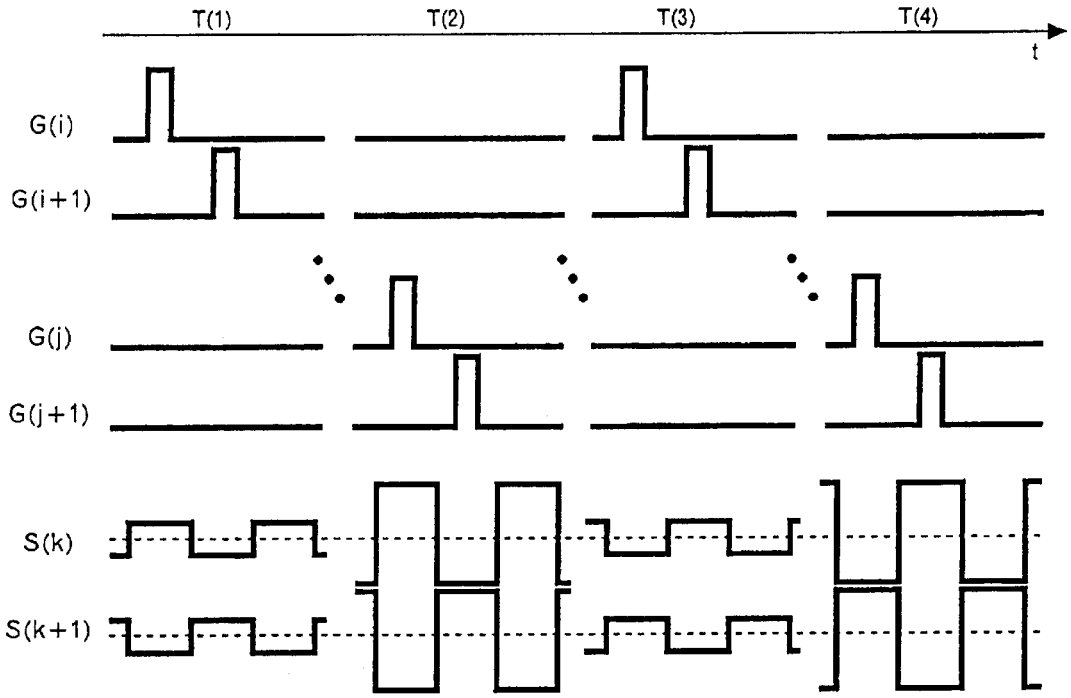
FIG. 3 is a schematic diagram illustrating image-quality test signals according to this embodiment.
Figure 4:
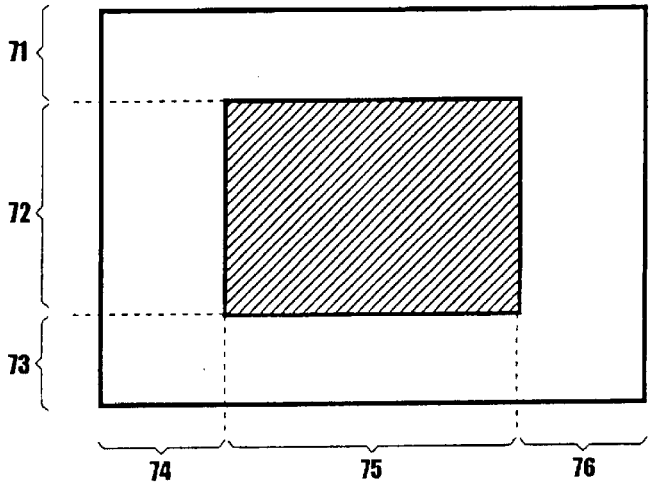
FIG. 4 is a schematic diagram depicting a test screen according to this embodiment.

FIG. 3 exemplifies test drive waveforms to be applied to the inspection circuits 4 and 5 in this embodiment. In this example, a test window is displayed by performing pixel inversion (dot inversion) driving. This window display is illustrated in FIG. 4. FIG. 3 merely shows some of test drive signals to be applied. Actually, signals having the same waveforms as those illustrated are continuously inputted to the LC cell 1. In FIG. 3, the abscissa represents the time. Periods T(1) and T(2) represent one frame period. The difference between the periods T(1) and T(2) and the periods T(3) and T(4) lies in that a signal S(k) and a signal S(k+1) are in the opposite phases to each other. While a single test screen is displayed with these periods T(1) to T(4) taken as one cycle, these signals are repeatedly and continuously inputted to the LC cell 1.

Other possible driving schemes include row inversion driving and column inversion driving. These necessary driving schemes can be accomplished easily by changing the input signal waveforms. Further, arbitrary gray level can be displayed by changing the input signal voltage.

Since R, G and B signals can be inputted independently in this example, arbitrary colors can be displayed.

FIG. 4 is a diagram showing the display of a test window as one example of a test display screen. The display screen consists of a plurality of blocks. Description will now be made for how to input the signals in FIG. 3 to the circuit in FIG. 2 in order to obtain the test screen display in FIG. 4. Note that the LC cell 1 is in normally white mode.

To begin with, the correlation of the individual areas in FIG. 2 with areas in FIG. 4 will be discussed. The area 61 in FIG. 2 corresponds to an area 72 in FIG. 4, and the area 62 corresponds to areas 71 and 73. Likewise, the area 63 in FIG. 2 corresponds to areas 74 and 76 in FIG. 4, and the area 64 corresponds to an area 75. These areas specify the blocks of the display screen.

Signals G(i) and G(i+1) in FIG. 3 are respectively inputted to the terminals 34 and 33 in FIG. 2. Likewise, signals G(j) and G(j+1) are respectively inputted to the terminals 32 and 31. The signal S(k) is inputted to the terminals 47, 49 and 51, and likewise, the signal S(k+1) is inputted to the terminals 48, 50 and 52. The signal S(k) in FIG. 3 is inputted to the terminals 41, 43 and 45 during the periods T(1) and T(3), and a signal waveform which has the same voltage amplitude as that in the periods T(1) and T(3) is also inputted during the periods T(2) and T(4). Likewise, the signal S(k+1) in FIG. 3 is inputted to the terminals 42, 44 and 46 during the periods T(1) and T(3), and a signal waveform which has the same voltage amplitude as that in the periods T(1) and T(3) is also inputted during the periods T(2) and T(4).

At the time of inspecting the display of the LC cell, a sufficiently high potential should be continuously inputted to the terminals 35 and 53 so that the test TFTs 22 are always turned on. This realizes a window display such that the block specified by the areas 72 and 75 in the LC cell in normally white mode has a black display and the other blocks have gray displays as shown in FIG. 4.

As another example of a test display screen, blue (B) may be displayed on the entire screen. In FIG. 2, columns of sub pixels are aligned in the order of R, G and B from the left-hand side. Therefore, blue (B) can be displayed on the entire screen by applying a drive signal, which represents a bright display, to the (3r)-th data signal line 12 (r: an integer), and applying a drive signal, which represents a black display, to the other data signal lines 12. Specifically, voltages having smaller amplitudes (the amplitude may be 0) than those of the signals S(k) and S(k+1) in FIG. 3 applied in the periods T(1) and T(3) are applied to the terminals 45, 46, 51 and 52, and voltages having the same amplitudes as those of the signals S(k) and S(k+1) applied in the periods T(2) and T(4) are applied to the terminals 41 to 44 and 47 to 50. Single color display of red (R) or green (G) can likewise be achieved, and every intermediate color can be displayed by the combination of R, G and B depending on the amplitudes of the applied voltages.

The use of the above-described method can display a display pattern needed for inspection with very few signal input terminals at the time of inspecting the display screen of the LC cell, thus realizing stable and low-cost image-quality inspection.

The LC module is completed by connecting a driver IC and a drive circuit, which generates control signals to be inputted to the driver IC, to the LC cell which has undergone the above-described image-quality inspection, and then attaching a back light and mechanical components. The test TFTs are designed to be disabled when a final product is driven for the purpose of stably separating inputs that have been bundled at the time of inspection.

As apparent from the above, because this embodiment has the inspection circuits with the above-described constitutions, signals needed for inspection of the image quality can be inputted to the LC cell without using multiple pin probes. This makes it possible to efficiently inspect the image quality of the LC cell.

Although the inspection circuits are formed for both the scan signal lines and the data signal lines in this embodiment, an inspection circuit may be provided only for either the scan signal lines or the data signal lines, and the conventional multiple pin probes may be used for the other signal lines to input test signals. For instance, multiple pin probes may be connected to the scan signal lines in place of the inspection circuit of the scan-signal line side.

It is also possible to change the number of input terminals as needed, in accordance with the type of the display screen or the drive conditions. Specifically, although two sets of input terminals are connected to the data signal lines 12 in this embodiment, the number of sets may be increased to ensure finer block display. Although the gate electrodes of all the test TFTs are connected to a single common gate line in this embodiment, as a matter of course, they may be separated into plural groups which are connected to associated common gate lines.

Conversely, the number of input terminals may be reduced. When only color display of the entire screen is inspected as an image-quality inspection, for example, the inspection circuit of the scan-signal line side is provided with only a single common gate terminal and a single common source terminal. The inspection circuit of the data-signal line side is provided with three common source terminals, each of which corresponds to the sub pixels of R, G and B, and a single gate terminal common to all the test TFTs. At least the full-color entire screen display can be presented by controlling the applied voltages by the inspection circuits.

Although the display area is divided into nine blocks in this embodiment, the display area may be separated into a larger number of blocks by reducing the sub pixels included in each area and alternately connecting each area to the associated set of input terminals in this embodiment. The increased number of blocks can ensure more detailed inspection. In the above-described embodiment, the source electrodes 23 of the test TFTs 22 are connected to one of the plural types of test terminals (terminals 31 to 34 or the terminals 41 to 52), and the gate electrodes 25 are connected to the common test terminal (terminal 35 or 53). However, on the contrary to this, the construction may be modified in such a way that the gate electrodes of the test TFTs are connected to one of the plural types of test terminals which are determined by a display pattern, and that the source electrodes are connected to a single common test terminal. Alternatively, the test TFTs may be connected to a part of the data signal lines alone.

Further, the inspection circuit of the present invention can be adapted not only to a display device which uses an LC cell but also to a display device which uses other active elements or an LC display device which does not use color filters. One example of such adaptable display devices is a self emitting type display that uses an active matrix-polymer light emitting diode (AM-PLED) or active matrix-organic light emitting diode (AM-OLED) which controls light emission by manipulating a voltage to be applied to an organic polymer film using an active element.

Although the preferred embodiments of the present invention have been described in detail, it should be understood that various changes, substitutions and alternations can be made therein without departing from spirit and scope of the present inventions as defined by the appended claims.

We claim:

1. An active matrix display device having a display region consisting of sub-pixels arrayed in a matrix fashion, the sub-pixels having switching elements, comprising:

a plurality of data signal lines and a plurality of scan signal lines for sending signals to the sub-pixels;

a plurality of test transistors, each of which is connected to one of the plurality of data signal lines; and a set of seven input terminals, each of which is connected to a test transistor, wherein a gate of each of the test transistors is connected to one of the input terminals, and three input terminals are consecutively connected to the source/drain of the test transistors connected to the even data signal lines and three input terminals are consecutively connected to the source/drain of the test transistors connected to the odd data signal lines, the test transistors control inputs of test signals to the sub-pixels, the display region is composed of a plurality of blocks, the data signal lines included in a first block of the plurality of blocks are connected to a first set of the input terminals via sources/drains of the test transistors, and the data signal lines included in a second block of the plurality of blocks are connected to a second set of the input terminals different from the first set of the input terminals via the sources/drains of the test transistors.

2. The active matrix display device according to claim 1, further comprising:

test transistors, each of which is connected to one of the scan signal lines;

a third set of the input terminals and a fourth set of the input terminals different from the third set of the input terminals, wherein the scan signal lines included in the first block of the plurality of blocks are connected to the third set of the input terminals via the sources/drains of the test transistors, and the scan signal lines included in the second block of the plurality of blocks are connected to the fourth set of the input terminals via the sources/drains of the test transistors.

3. The active matrix display device according to claim 2, wherein the blocks adjacent to each other in the direction, to which the data signal lines extend, are connected to the different sets of the input terminals.

4. The active matrix display device according to claim 1, wherein the blocks adjacent to each other in the direction, to which the scan signal lines extend, are connected to different sets of the input terminals.

5. The active matrix display device according to claims 1, wherein the sub-pixels displaying the same color among the sub-pixels connected to the same set of the input terminals are connected to the same input terminal.

6. The active matrix display device according to claims 1, further comprising:

a drive circuit connected to the plurality of data signal lines and the plurality of scan signal lines, wherein when the drive circuit controls an input of a screen display signal, all of the test transistors are held in an OFF state.

7. The active matrix display device according to claim 1, wherein all of the gates of the test transistors connected to the data signal lines on an array substrate are connected to the first input terminal.

8. The active matrix display device according to claims 1, wherein the first block and the second block are arranged adjacently to each other.

9. The active matrix display device according to claim 1, wherein all of the gates of the test transistors connected to the scan signal lines on an array substrate are connected to the first input terminal.

10. An active matrix display device having a display region consisting of sub-pixels arrayed in a matrix fashion, the sub-pixels having switching elements, comprising:

a plurality of data signal lines and a plurality of scan signal lines for sending signals to the sub-pixels;

a plurality of test transistors, each of which is connected to one of the plurality of scan signal lines; and a set of three of input terminals, each of which is connected to a test transistor, wherein a gate of each of the test transistors is connected to one of the input terminals, and the source/drain of each test transistor is alternatively connected to the remaining two input terminals, the test transistors control inputs of test signals to the sub-pixels, the display region is composed of a plurality of blocks, the scan signal lines included in a first block of the plurality of blocks are connected to a first set of the input terminals via sources/drains of the test transistors, and the scan signal lines included in a second block of the plurality of blocks are connected to a second set of the input terminals different from the first set of the input terminals via the sources/drains of the test transistors.

11. The active matrix display device according to claim 10, wherein the sub-pixels displaying the same color among the sub-pixels connected to the same set of the input terminals are connected to the same input terminal.

12. The active matrix display device according to claim 10, further comprising:

a drive circuit connected to the plurality of data signal lines and the plurality of scan signal lines, wherein when the drive circuit controls an input of a screen display signal, all of the test transistors are held in an OFF state.

13. The active matrix display device according to claim 18, wherein the first block and the second block are arranged adjacently to each other.

14. An active matrix display device having a display region consisting of sub-pixels arrayed in a matrix fashion, the sub-pixels having switching elements, comprising:

a plurality of data signal lines and a plurality of scan signal lines for sending signals to the sub-pixels;

a plurality of test transistors, each of which is connected to one of the plurality of data signal lines;

a plurality of input terminals, each of which is connected to one of the plurality of test transistors, wherein a gate of each of the test transistors is connected to one of the plurality of input terminals, and three input terminals are consecutively connected to the source/drain of the test transistors connected to the even data signal lines and three input terminals are consecutively connected to the source/drain of the test transistors connected to the odd data signal lines, source/drain of each of a plurality of the test transistors are connected to one of the data signal lines and one of the input terminals, the test transistors control inputs of test signals to the sub-pixels, an n-th data signal line and an n+3-th data signal line are connected to the different input terminals via the test transistors.

15. An active matrix display device having a display region consisting of sub-pixels arrayed in a matrix fashion, the sub-pixels having switching elements, comprising:

a plurality of data signal lines and a plurality of scan signal lines for sending signals to the sub-pixels;

a plurality of test transistors, each of which is connected to one of the plurality of data signal lines; and a set of seven input terminals, each of which is connected to a plurality of the test transistors, and three input terminals are consecutively connected to the source/drain of the test transistors connected to the even data signal lines and three input terminals are consecutively connected to the source/drain of the test transistors connected to the odd data signal lines, wherein a gate of each of the test transistors is connected to one of the plurality of input terminals, source/drain of each of the plurality of test transistors are connected to one of the data signal lines and one of the input terminals, the test transistors control inputs of test signals to the sub-pixels, each columns of sub-pixels displays one color, the data signal lines of the columns of the sub-pixels displaying the same color and adjacent to each other are connected to the different input terminals via the test transistors.

16. An image quality inspection method for an active matrix display device having a display region consisting of sub-pixels arrayed in a matrix fashion, comprising the steps of:

inputting test signals to a first set of three input terminals;

inputting test signals to a second set of seven input terminals;

transmitting the inputted test signal to a plurality of test transistors connected to the input terminals of the first set of the input terminals; and transmitting the inputted test signals to the plurality of test transistors connected to the input terminals of the second set of the input terminals, wherein inputs of the test signals to a first block in the display region are controlled by the test transistors connected to the first set of the input terminals; and the inputs of the test signals to a second block in the display region are controlled by the test transistors connected to the second set of input terminals.

17. The image quality inspection method according to claim 16, wherein the method further comprises providing the first and second blocks in three sub-pixel columns, and arranging the first and second blocks adjacently to each other.

18. An active matrix display device comprising:

an array substrate having sub pixel sections arrayed in a matrix fashion, each sub pixel section having a switching element; and an opposing substrate opposite to the array substrate, the array substrate including:

a plurality of data signal lines and a plurality of scan signal lines for sending signals to the sub pixel sections;

a plurality of test transistors, respectively connected to the plurality of data signal lines; and a set of seven input terminals for inputting test signals, wherein drains or sources of the test transistors are connected to the data signal lines, the gates of the test transistors are connected to a first input terminal of the input terminals, the sources or drains of a plurality of the test transistors are connected to a second input terminal of the input terminals, and the test transistors control inputting of the test signals to the sub pixel sections.

19. The active matrix display device as claimed in claim 18, wherein the switching elements of the sub pixel sections and the test transistors are thin film transistors formed of amorphous silicon.

20. The active matrix display device as claimed in claim 18, wherein each of the sub pixel sections can display a single color; and all of the plurality of test transistors connected to the second input terminal are connected to the sub pixel sections which display a same color.

21. The active matrix display device as claimed in claim 20, wherein the sources or drains of the test transistors that are connected to adjacent ones of the data signal lines are connected to different ones of the plurality of input terminals.

22. The active matrix display device as claimed in claim 18, wherein each of the sub pixel sections can display a single color; and all of the plurality of test transistors connected to the first input terminal are connected to the sub pixel sections which display a same color.

23. The active matrix display device as claimed in claim 18, wherein the gates of all of the test transistors connected to the data signal lines on the array substrate are connected to the first input terminal.

24. The active matrix display device as claimed in claim 18, wherein each of the sub pixel sections can display a single color;

all of the plurality of test transistors connected to the second input terminal are connected to the sub pixel sections which display a same color;

the gates of all of the test transistors connected to the data signal lines on the array substrate are connected to the first input terminal; and the sources or drains of the test transistors that are connected to adjacent ones of the data signal lines are connected to different ones of the plurality of input terminals.

25. The active matrix display device as claimed in claim 18, wherein the array substrate further comprises: scan-line test transistors, respectively connected to the plurality of scan signal lines; and a plurality of scan-line input terminals for inputting test signals to the scan signal lines, drains or sources of the scan-line test transistors are connected to the scan signal lines, gates of a plurality of the scan-line test transistors are connected to a first scan-line input terminal of the plurality of scan-line input terminals, the sources or drains of a plurality of the scan-line test transistors are connected to a second scan-line input terminal in the plurality of scan-line input terminals, and the scan-line test transistors control inputting of the test signals to the sub pixel sections.

26. The active matrix display device as claimed in claim 25, wherein the sources or drains of the scan-line test transistors that are connected to adjacent ones of the scan signal lines are connected to different ones of the plurality of scan-line input terminals.

27. The active matrix display device as claimed in claim 18, further comprising:

a drive circuit connected to the plurality of data signal lines and the plurality of scan signal lines, wherein when the drive circuit controls inputting of a screen display signal, all of the test transistors are held in an OFF state.

28. An active matrix display device comprising:

an array substrate having sub pixel sections arrayed in a matrix fashion, each sub pixel section having a switching element; and an opposing substrate opposite to the array substrate, the array substrate including:

a plurality of data signal lines and a plurality of scan signal lines for sending signals to the sub pixel sections;

a plurality of test transistors, respectively connected to the plurality of scan signal lines; and a set of three input terminals for inputting test signals, wherein drains or sources of the test transistors are connected to the scan signal lines, the gates of the test transistors are connected to a first input terminal of the input terminals, the sources or drains of a plurality of the test transistors are connected to a second input terminal of the plurality of input terminals, and the test transistors control inputting of the test signals to the sub pixel sections.

29. The active matrix display device as claimed in claim 28, wherein the switching elements of the sub pixel sections and the test transistors are thin film transistors formed of amorphous silicon.

30. The active matrix display device as claimed in claim 28, wherein each of the sub pixel sections can display a single color; and all of the plurality of test transistors connected to the second input terminal are connected to the sub pixel sections which display a same color.

31. The active display device as claimed in claim 30, wherein the sources or drains of the test transistors that are connected to adjacent ones of the scan signal lines are connected to different ones of the plurality of input terminals.

32. The active matrix display device as claimed in claim 30, wherein the sources or drains of the test transistors that are connected to adjacent ones of the data signal lines are connected to different ones of the plurality of input terminals.

33. The active matrix display device as claimed in claim 28, wherein each of the sub pixel sections can display a single color; and all of the plurality of test transistors connected to the first input terminal are connected to the sub pixel sections which display a same color.

34. The active matrix display device as claimed in claim 28, wherein the sources or drains of the test transistors that are connected to adjacent ones of the scan signal lines are connected to different ones of the plurality of input terminals.

35. The active matrix display device as claimed in claim 28, wherein the gates of all of the test transistors connected to the scan signal lines on the array substrate are connected to the first input terminal.

36. The active matrix display device as claimed in claim 28, further comprising:

a drive circuit connected to the plurality of data signal lines and the plurality of scan signal lines, wherein when the drive circuit controls inputting of a screen display signal, all of the test transistors are held in an OFF state.

37. An image quality inspection method for an active matrix display device including an array substrate having sub pixel sections arrayed in a matrix fashion, each sub pixel section having a switching element, and an opposing substrate opposite to the array substrate, comprising:

a first step of inputting test signals from a first set of six input terminals;

a second step of inputting a test signal from a seventh input terminal;

a third step of sending the test signal inputted from the first set of input terminal to the source electrodes of a plurality of first test transistors connected to the first set of input terminals;

a fourth step of sending the test signals inputted from the seventh input terminal to the gate electrodes of the plurality of first test transistors connected to the seventh input terminal; and a fifth step of sending the test signals to the sub pixel sections from the plurality of test transistors via data signal lines respectively connected to the plurality of test transistors, wherein the plurality of test transistors control inputting of the test signals to the sub pixel sections to thereby display a desired display screen.

38. The image quality inspection method as claimed in claim 37, wherein the fifth step sends the test signal to the sub pixel sections which display a same color.

39. The image quality inspection method of claim 37, further comprising the steps of:

a first step of inputting a test signal from an input terminal;

a second step of sending the input test signal to a plurality of test transistors connected to the input terminal; and a third step of sending the test signal to the sub pixel sections from the plurality of test transistors via scan signal lines respectively connected to the plurality of test transistors, wherein the plurality of test transistors control inputting of the test signal to the sub pixel sections to thereby display a desired display screen.

* * * * *

UNITED STATES PATENT AND TRADEMARK OFFICE

CERTIFICATE OF CORRECTION

PATENT NO. : 6,784,862 B2
DATED : August 31, 2004
INVENTOR(S) : Masato Ikeda et al.

It is certified that error appears in the above-identified patent and that said Letters Patent is hereby corrected as shown below:

Column 11,
Line 8, “claim 18” should read -- claim 10 --
Line 59, “columns” should read -- column --

Column 14,
Line 13, after “active” insert -- matrix --

Signed and Sealed this

Eighth Day of February, 2005

JON W. DUDAS
*Director of the United States Patent and Trademark Office*